US006168246B1

(12) United States Patent
Kurihara

(10) Patent No.: US 6,168,246 B1
(45) Date of Patent: Jan. 2, 2001

(54) ARTICLE PROVIDING APPARATUS WHICH HAS EXCELLENT LOADING CAPACITY AND ENABLES REDUCTION IN ITS INSTALLATION AREA

(75) Inventor: Toshihiko Kurihara, Isesaki (JP)

(73) Assignee: Sanden Corp.(JP)

( * ) Notice: Under 35 U.S.C. 154(b), the term of this patent shall be extended for 0 days.

(21) Appl. No.: 09/347,299

(22) Filed: Jul. 6, 1999

(51) Int. Cl.[7] ..... A47F 3/06
(52) U.S. Cl. ..... 312/139.2; 312/119; 312/120
(58) Field of Search ..... 312/118, 119, 312/120, 121, 122, 123, 138.1, 139.2, 139.1

(56) References Cited

U.S. PATENT DOCUMENTS

| | | | | |
|---|---|---|---|---|
| 908,344 | * | 12/1908 | Simanek | 312/118 X |
| 1,272,989 | * | 4/1918 | Ostram | 312/120 X |
| 1,611,742 | * | 12/1926 | Hammer | 312/118 X |
| 2,233,559 | * | 3/1941 | Shields | 312/119 X |
| 3,087,648 | | 4/1963 | Cope . | |
| 4,995,498 | | 2/1991 | Menke . | |
| 5,057,977 | * | 10/1991 | Kurzman | 312/122 X |
| 6,047,855 | | 4/2000 | Lin . | |

FOREIGN PATENT DOCUMENTS

| | | | | |
|---|---|---|---|---|
| 26 98255 | * | 5/1994 | (FR) | 312/138.1 X |
| 52-43499 | | 4/1977 | (JP) . | |
| 3-189897 | | 8/1991 | (JP) . | |
| 4-241699 | | 8/1992 | (JP) . | |
| 5-94582 | | 4/1993 | (JP) . | |
| 6-03916 | | 1/1994 | (JP) . | |
| 6-176260 | | 6/1994 | (JP) . | |

* cited by examiner

*Primary Examiner*—Janet M. Wilkens
*Assistant Examiner*—Michael J. Fisher
(74) *Attorney, Agent, or Firm*—Banner & Witcoff, Ltd.

(57) ABSTRACT

In an article providing apparatus, a storage rack (1) has a front face through which articles are loaded in the storage rack. The front face of the storage rack is covered by a covering member having a sample showcase (4) for showing a sample. The sample showcase is displaceable to enable the front face of the storage rack be exposed.

3 Claims, 4 Drawing Sheets

ARTICLE PROVIDING APPARATUS WHICH HAS EXCELLENT LOADING CAPACITY AND ENABLES REDUCTION IN ITS INSTALLATION AREA

BACKGROUND OF THE INVENTION

The present invention relates to an article providing apparatus for storing articles and for discharging a selected one or ones of the articles in response to operation of an operational unit included in the article providing apparatus.

A conventional article providing apparatus is disclosed in, for example, Japanese Unexamined Utility Model Publication (JP-U) No. 06-3916. The conventional article providing apparatus comprises a storage rack for storing articles, a delivery port, and a conveyance means disposed along the storage rack for conveying a selected one of ones of the articles from the storage rack to the delivery port. The conventional article providing apparatus can handle a wide variety of articles by dividing the storage rack into many parts. Therefore, the realization of an unmanned retail store can be expected by applying the existing technique for automatic vending machines to the conventional apparatus to actualize an article providing apparatus or an automatic vending system.

One problem in this case is the way articles are loaded into the storage rack. Since there is the conveying means on one side of the storage rack, it is not advisable and is difficult to do the loading operation on this side of the storage rack. On the other hand, in case that the apparatus is structured to do the loading operation on the opposite side of the storage rack, a large loading space is required, increasing the size of the apparatus as a whole. That is, it is also not advisable. Actually, the opposite side of the storage rack is covered by a panel. Providing the loading space between the panel and the storage rack makes the apparatus significantly large.

SUMMARY OF THE INVENTION

It is therefore an object of the present invention to provide an article providing apparatus which has excellent loading capacity and enables the reduction in its installation area.

Other objects of the present invention will become clear as the description proceeds.

According to the present invention, there is provided an article providing apparatus which comprises a storage rack for storing articles, said storage rack having a front face through which said articles are loaded in said storage rack. The article providing apparatus further comprises a covering member covering the front face of said storage rack and including a sample showcase for showing a sample. The sample showcase being displaceable to enable the front face of said storage rack be exposed.

DESCRIPTION OF THE PREFERRED EMBODIMENT

Figure 1:
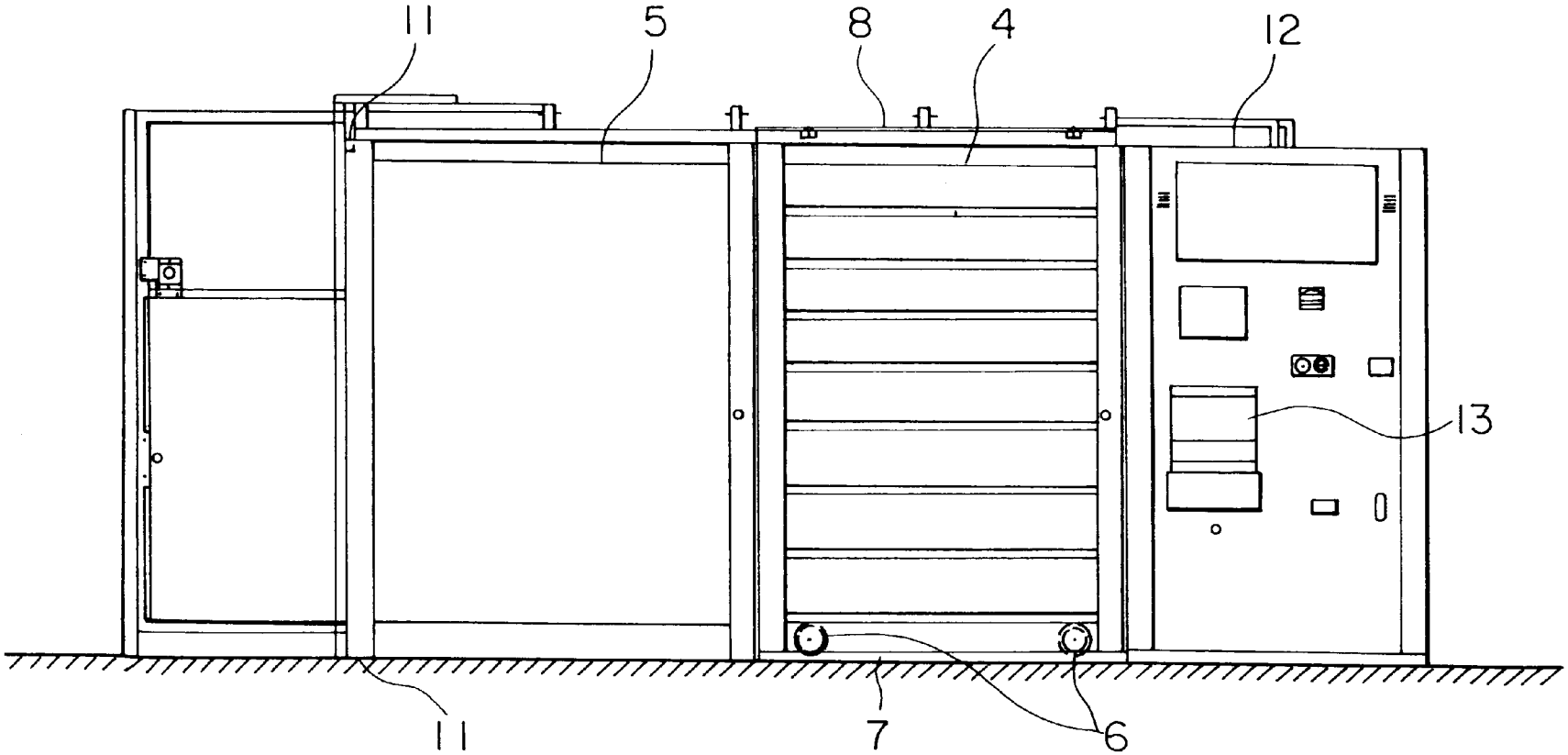
FIG. 1 is a front view of an article providing apparatus according to an embodiment of the present invention.
Figure 2:
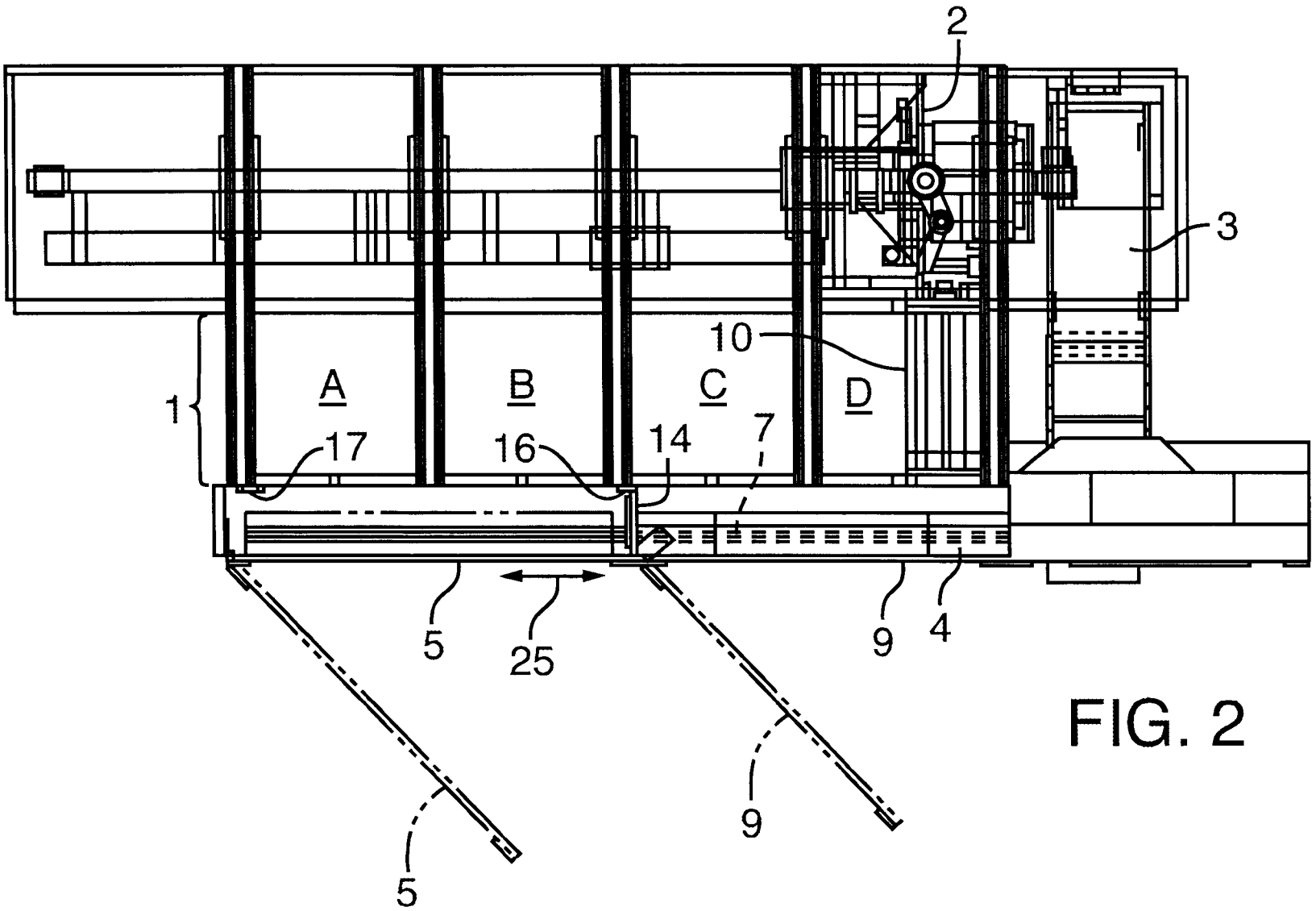
FIG. 2 is a top view of the article providing apparatus shown in FIG. 1.
Figure 3:
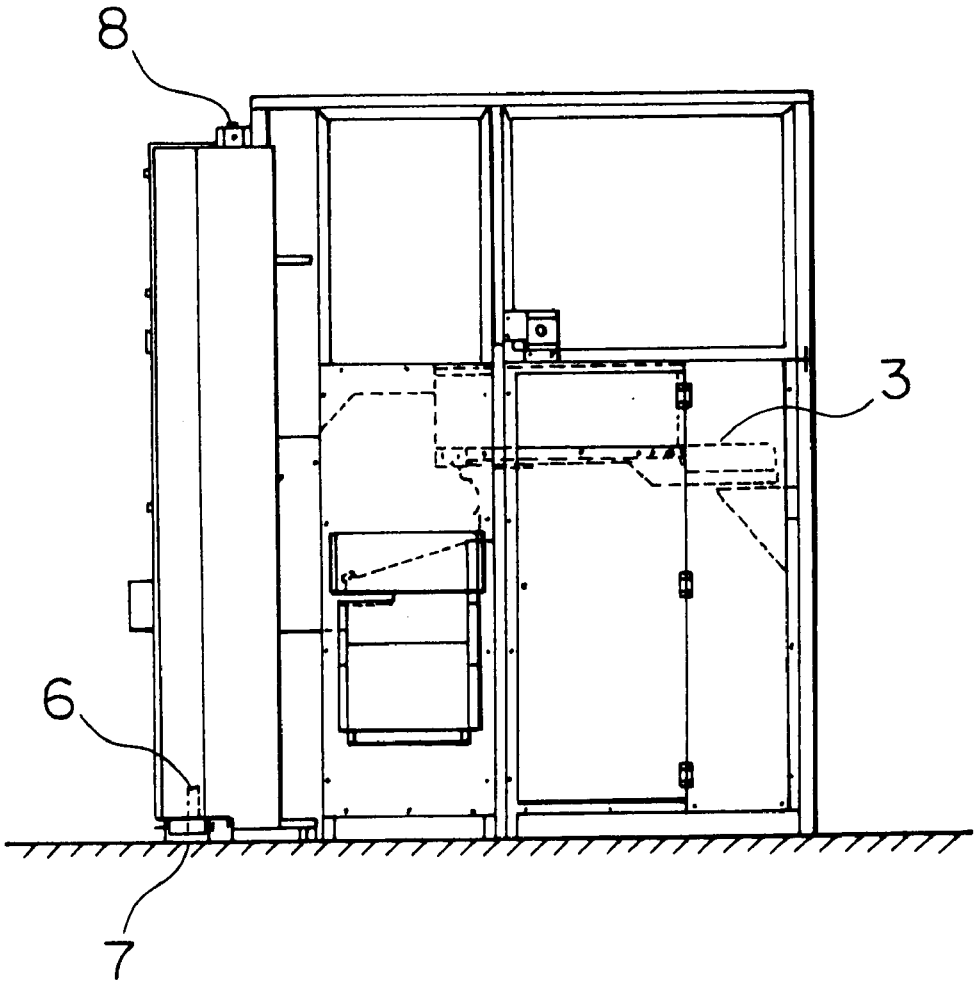
FIG. 3 is a right side view of the article providing apparatus shown in FIG. 1.

With reference to FIGS. 1 through 3, description will be made as regards an article providing apparatus according to an embodiment of the present invention.

The article providing apparatus comprises a storage rack 1 for storing articles and a conveying robot 2 disposed to confront a rear face of the storage rack 1. The inside of the storage rack 1 is divided into many regions A, B, C, and D whereby a wide variety of articles can be stored. The conveying robot 2 moves vertically and horizontally in response to a delivery command to pick up a designated article rearwardly from the storage rack 1 and conveys the article along the rear face of the storage rack 1 to a lateral side, e.g., to the right. A conveyor 3 is disposed adjacent to the right sides of the storage rack 1 and the conveying robot 2. The conveyor 3 receives the article from the conveying robot 2 and conveys the article forward. A combination of the conveying robot 2 and the conveyor 3 will be referred to as a conveyance arrangement.

The storage rack 1 is structured to allow the operation of loading articles at a front face thereof. On the front face of the storage rack 1, a sample showcase 4 and an advertisement case 5 are arranged right and left, respectively. The sample showcase 4 and the advertisement case 5 are arranged right and left to completely cover the front face of the storage rack 1. That is, a combination of the sample showcase 4 and the advertisement case 5 is referred to as a covering member which is for covering the front face of the storage rack 1. The sample showcase 4 is formed to be as small as possible in the depth direction, but thicker than that of the advertisement case 5, thereby making them slender.

The sample showcase 4 has rollers 6 at the lower portion thereof whereby it can be opened and closed like a sliding door. That is, the sample showcase 4 is supported to be allowed to slide to the left as necessary by a lower guide rail 7 and an upper slide guide rail 8, as illustrated by the double-headed arrow 25 in FIG. 2. When the sample showcase 4 is moved to the left, the right half of the front face of the storage rack 1 is opened so that articles can be loaded through this open right half into a storage space 10 for the regions C and D of the storage rack 1.

The sample showcase 4 has a sample display door 9 at the front thereof. Forward opening of the sample display door 9 allows the exchange of samples.

The advertisement case 5 is attached to the storage rack 1 by means of upper and lower hinges 11 so that the advertisement case 5 can be opened and closed like a hinged door known in the art. That is, the advertisement case 5 is pivotable forward about the hinges 11 as its axis as necessary. When the advertisement case 5 is pivoted forward, the left half of the front face of the storage rack 1 is opened so that so that articles can be loaded through this open left half into the regions A and B of the storage rack 1.

In case that the advertisement case 5 disturbs the leftward movement of the sample showcase 4, it is preferable to pivot the advertisement case 5 forward.

An operational unit 12 whereby a customer operates the apparatus for designating an article is disposed in front of the conveyor 3 and adjacent to the right face of the sample showcase 4. That is, the operational unit 12 is incorporated in a space at a front corner of the article providing apparatus. The operational unit 12 is provided with a delivery port (purchasing port) 13 formed in the front thereof.

Figure 4:
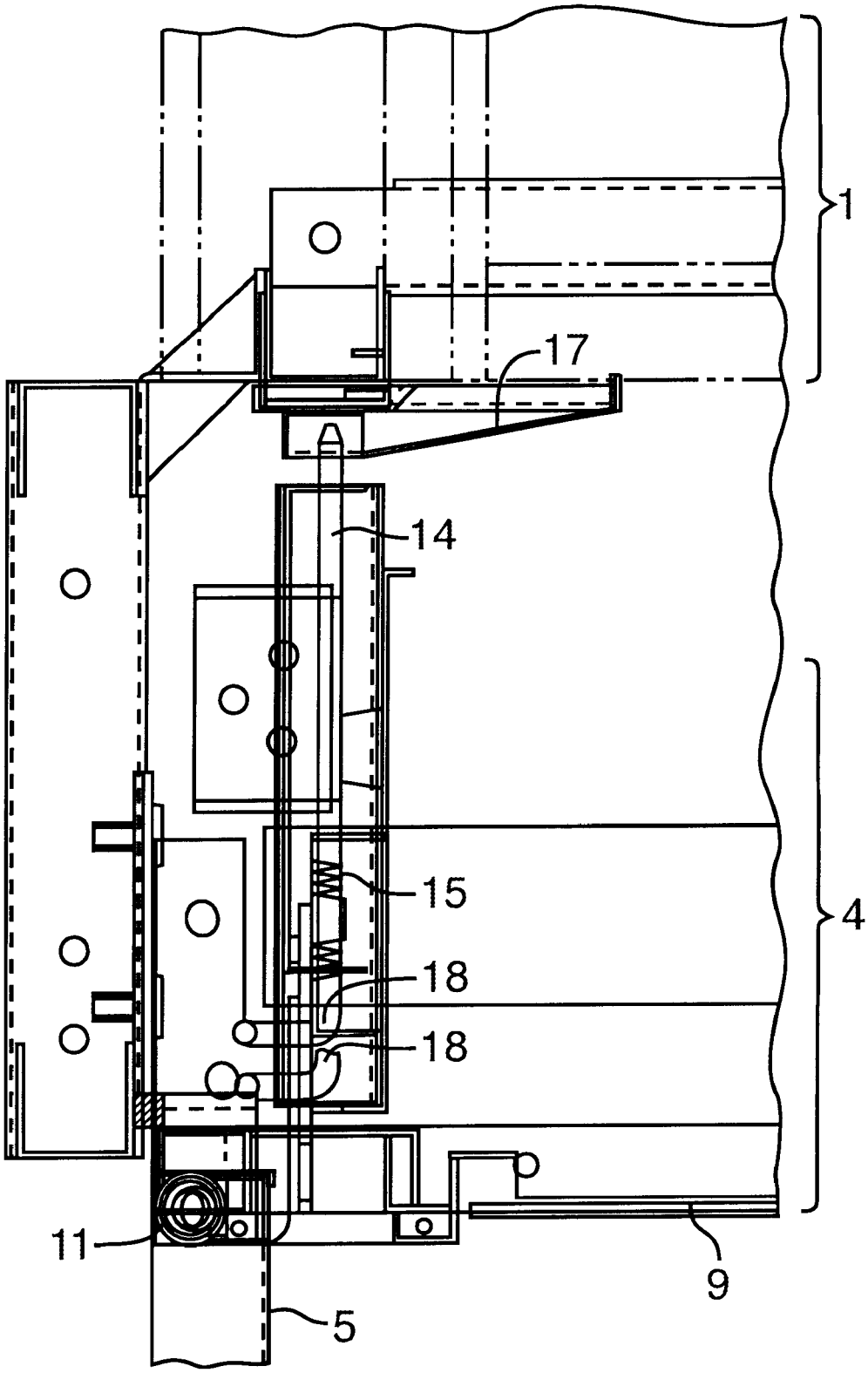
FIG. 4 is an enlarged view of a main portion shown in FIG. 2.

Referring to FIG. 4 in addition, the sample showcase 4 is provided with a stopper pin 14, as a stopping projection, which is disposed at the left end of the sample showcase 4 so that the stopper pin 14 can move forwards and backwards within a predetermined range, a coil spring 15 as a biasing means for biasing the stopper pin 14 rearwardly. On the other hand, the storage rack 1 is provided with pin receiving portions 16, 17, as engaging concavities, for engaging with the stopper pin 14. The pin receiving portions 16, 17 are formed at a position corresponding to the stopper pin 14 when the sample showcase 4 is in the fully closed state, i.e. the middle portion of the front face of the storage rack 1, and at a position corresponding to the stopper pin 14 when the sample showcase 4 is in the fully opened state, i.e. the left end portion of the front face of the storage rack 1, respectively. The sample showcase 4 is fixed in the closed state by the engagement between the stopper pin 14 and the pin receiving portion 16 when it is fully closed and is fixed in the opened state by the engagement between the stopper pin 14 and the pin receiving portion 17. In case of the former, a combination of the stopper pin 14 and the pin receiving portion 16 will be referred to as a closed state stopper. In case of the latter, a combination of the stopper pin 14 and the pin receiving portion 17 will be referred to as an opened state stopper. The engagement between the stopper pin 14 and the pin receiving portions 16, 17 can be easily released by moving the stopper pin 14 forward by pulling a handle 18. Handle 18 is shown broken away from stopper pin 14 to illustrate the pulled forward release position of stopper pin 14. Handle 18 is also shown connected to stopper pin 14 to illustrate stopper pin 14 engaged with receiving portion 17.

Normally, the sample showcase 4 is fixed in the fully closed state by the engagement between the stopper pin 14 and the pin receiving portion 16. Therefore, there is no possibility of unexpected opening of the sample showcase 4.

To load articles into the storage rack 1, the stopper pin 14 is released from the pin receiving portion 16 and the sample showcase 4 is moved to left to be opened or the advertisement case 5 is opened forward. In this way, the articles are loaded into the regions A through D of the storage rack 1 at the front face of the storage rack 1. That is, the storage rack 1 has a front loading structure known in the art. As the sample showcase 4 is fully opened, the stopper pin 14 is automatically engaged with the pin receiving portion 17, fixing the sample showcase 4 in this fully opened state, thereby ensuring the safety for the loading operation.

After loading the articles into the storage rack 1, the sample showcase 4 and/or the advertisement case 5 are returned to be closed. As the sample showcase 4 is fully closed, the stopper pin 14 is automatically engaged with the pin receiving portion 16, fixing the sample showcase 4 in the fully closed state.

As a delivery command is output according to the operation of an operator or customer with the operational unit 12, the conveying robot 2 picks up a designated article rearwardly from the storage rack 1 and conveys the article to the right to transfer the article to the conveyor 3. The conveyor 3 conveys the article forward to feed the article to the operational unit 12. Therefore, the operator or customer can obtain the article through the delivery port 16.

As described in the above, the sample showcase 4 provided at the front face of the storage rack 1 can be opened so that articles can be loaded into the storage rack 1 through the opening. Therefore, the article providing apparatus has excellent loading capacity and enables the reduction in its installation area can be obtained.

While the present invention has thus far been described in connection with a single embodiment thereof, it will readily be possible for those skilled in the art to put this invention into practice in various other manners. For example, the conveyor and the operational unit may be disposed adjacent to the left sides of the storage rack and the advertisement case.

What is claimed is:

1. An article providing apparatus comprising:

a storage rack for storing articles, said storage rack having a front face through which said articles are loaded in said storage rack; and a covering member covering the front of said storage rack, said covering member comprising:

a sample showcase for showing a sample, said sample showcase being moveable in a horizontal direction to be opened and closed by sliding motion and enabling the front face of said storage rack be exposed; and an advertisement case for showing advertisement, said advertisement case being rotatable around a portion thereof to be opened and closed by pivoting motion and enabling the front face of said storage rack to be exposed.

2. An article providing apparatus as claimed in claim 1, wherein said sample showcase has an opened state at which the front face of said storage rack is exposed and a closed state at which the front face of said storage rack is covered by said sample showcase, said article providing apparatus further comprising stopper means for stopping said sample showcase in a selected one of said opened and said closed states.

3. An article providing apparatus as claimed in claim 1, wherein said sample showcase is insertable between said storage rack and said advertisement case.

* * * * *